United States Patent [19]

Maddagiri

[11] 4,004,424

[45] Jan. 25, 1977

[54] METHOD FOR LIMITING BACK PRESSURE ON STEAM TURBINE

[75] Inventor: Aswath Maddagiri, Concord, Calif.

[73] Assignee: Bechtel International Corporation, San Francisco, Calif.

[22] Filed: May 16, 1975

[21] Appl. No.: 578,126

[52] U.S. Cl. ..... 60/646; 60/657; 60/677; 60/690; 60/692

[51] Int. Cl.[2] ..... F01K 13/02

[58] Field of Search ..... 60/646, 657, 688, 690, 60/693, 677, 692

[56] References Cited

UNITED STATES PATENTS

| | | | |
|---|---|---|---|
| 3,731,488 | 5/1973 | Sasakura et al. | 60/693 X |
| 3,820,334 | 6/1974 | Heller et al. | 60/692 X |
| 3,820,336 | 6/1974 | Schwarzenbach | 60/693 |
| 3,851,702 | 12/1974 | Heller et al. | 60/692 X |

*Primary Examiner*—Martin P. Schwadron
*Assistant Examiner*—H. Burks, Sr.

[57] ABSTRACT

Steam is removed from the steam cycle of a turbine when the back pressure on the turbine exceeds a predetermined level. Heat is then extracted from the removed steam and dissipated in a cooling tower of a cooling system for the turbine's condenser. Increased temperatures in the cooling tower augment thermal fan action, resulting in lower coolant temperatures and limiting the back pressure on the turbine. When the back pressure on the turbine decreases to an acceptable level, the steam is redirected into the steam cycle.

In a preferred embodiment, heat is extracted from steam by passing the steam through the high temperature coil of a vapor-absorption generator. The high temperature vapor formed in the generator transfers the heat to the heat dissipating surfaces of a cooling tower or into heat-exchange relationship with an exhaust coolant discharged from a steam condenser. In alternative embodiments the removed steam is passed directly through an auxiliary coil in the cooling tower or through a heat exchanger that elevates the temperature of the coolant as it is passed from the condenser to the tower.

11 Claims, 4 Drawing Figures

METHOD FOR LIMITING BACK PRESSURE ON STEAM TURBINE

BACKGROUND OF THE INVENTION

The back pressure on a steam turbine is determined by the temperature of the coolant in the condenser coils over which the turbine exhaust steam passes, and excessive back pressure on a steam turbine makes the machine inoperable. Thus, the temperature of the coolant must be carefully controlled to limit the back pressure for continued production of power.

Excessive back pressures occur when climatic conditions constrain or impair the effectiveness of a cooling tower, producing higher temperatures of the coolant returned to the condenser. Moreover, when such conditions prevail there has been no realistic, economical alternative other than to shut down the steam turbine.

The inefficiencies and deleterious effects attributable to high back pressures are, of course, well known to persons of ordinary skill in the design and operation of steam power plants. Moreover, various means have been devised to lower back pressures by reducing the temperature of the condenser coolant. For example, U.S. Pat. No. 2,982,864 discloses a few forms of apparatus which utilize some of the waste heat of a boiler to enchance cooling of the condenser coolant.

SUMMARY OF THE INVENTION

This invention provides a unique solution to the problems experienced in operating low back pressure turbines under unfavorable climatic conditions. The novelty of the invention resides largely in the concept of selectively removing steam from the steam cycle when the back pressure on the turbine exceeds a predetermined level and utilizing the heat of that steam to increase the air temperatures in a natural draft cooling tower while producing lower coolant temperatures for circulation through the steam condenser. The increased temperatures in the cooling tower augment natural draft thermal fan action, resulting in enhanced cooling of the circulated coolant to limit back pressures on the steam turbine. In addition, the removal of steam from the steam cycle reduces the heat load on the condenser.

The heat removed from the steam may be applied to the cooling tower by increasing the temperature of the coolant discharged from the steam condenser or, alternatively, applied directly to the tower through an auxiliary high temperature coil. Either method may be practiced utilizing conventional vapor absorption systems to produce high temperature vapors.

It will be apparent from the above brief description that a primary object of this invention is to provide an improved method for operating a steam turbine to limit back pressures under adverse, high humidity and high atmospheric conditions.

Another object is to provide a method of the kind described wherein the coolant discharged from a steam condenser is further heated to increase temperatures in the cooling tower and augment thermal fan action.

A further object of the invention is to extend the normal range of operation for turbines by limiting the back pressures under adverse, high humidity and high atmospheric temperature conditions.

Other objects of this invention will become apparent in view of the following detailed description.

In the drawings forming a part of this application and in which like parts are identified by like reference numerals throughout the same:

Figure 1:
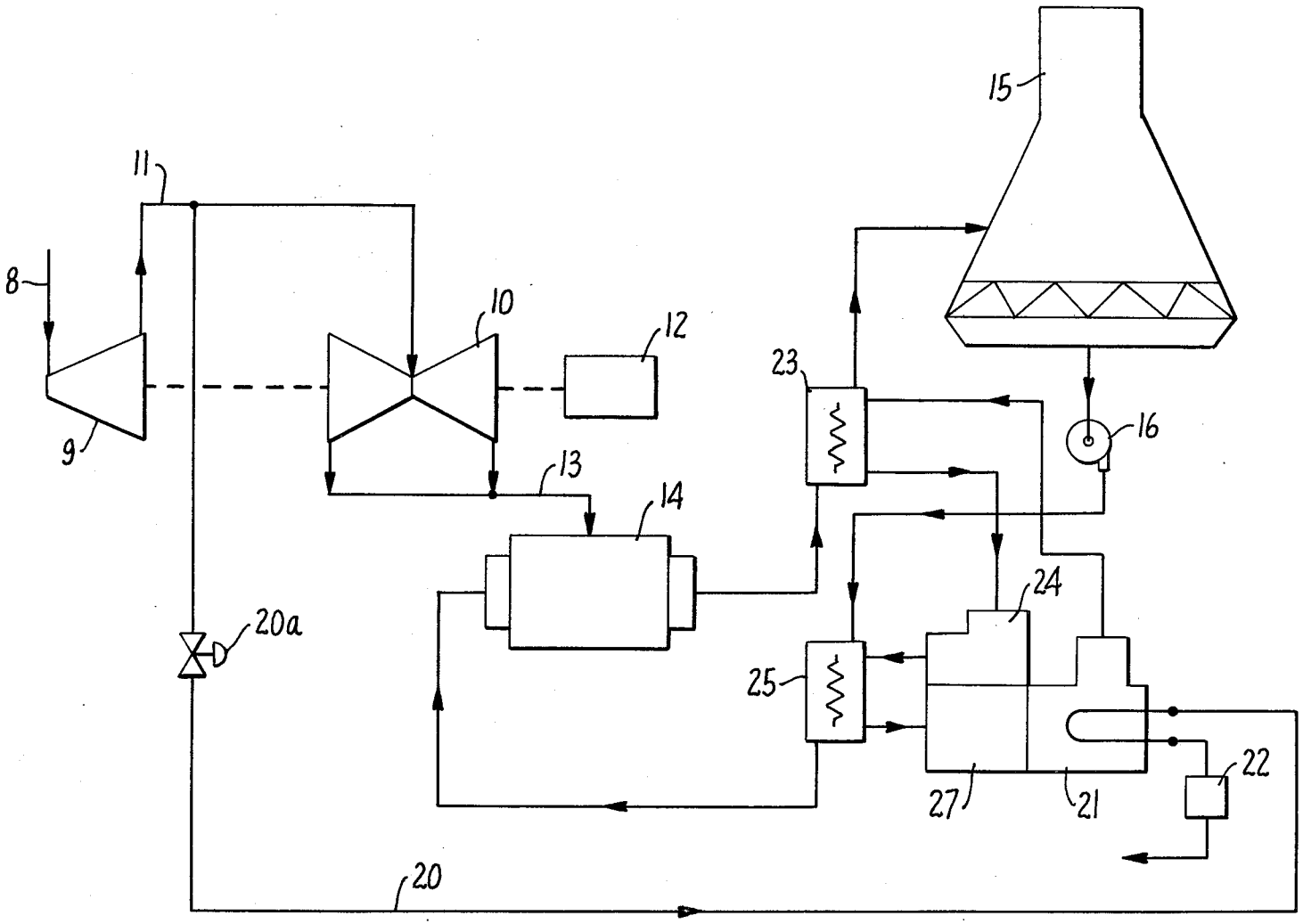
FIG. 1 is a diagram of apparatus for practicing this invention in connection with a wet cooling tower system and applying removed steam to a vapor absorption system.

Referring to FIG. 1, a main steam line 8 connects with a high pressure turbine 9 and a crossover steam line 11 connects turbine 9 with a low pressure turbine 10. Turbines 9 and 10 are connected in tandem to drive a generator 12 in the customary manner.

A steam line 13 carries exhaust steam from turbine 10 to a water-cooled condenser 14; and water is circulated through the condenser to and from a cooling tower 15 by a pump 16. The foregoing apparatus, it will be understood, is conventionally used in a wet cooling tower system.

More particularly as regards this invention, steam is removed from the turbine cycle through a conduit 20 and a control valve **20*a* is applied to the vapor generator 21 of a vapor absorption system. Heat is thereby extracted from the steam, causing it to condense and drain into a drip tank 22. The hot vapor formed in generator 21 is carried to the coil of a heat exchanger 23 through which the coolant water leaving condenser 14 passes on the way to cooling tower 15. Thus, the vapor entering heat exchanger 23 increases the temperature of the already heated coolant from the condenser. The vapor is thereby cooled, condensed and deposited in a receiver 24.**

In the customary manner of a vapor absorption refrigeration system, liquid within the receiver passes through an expansion valve and into the chiller 25 under low pressure at low temperature. Here the vapor picks up the heat load of the partially cooled water returning from cooling tower 15 to condenser 14.

The vapor then passes to an absorber 27. In the absorber, a weak, cold circulating solvent "absorbs" the vapor, making a strong vapor solution; the strong solution is pumped into the generator; and the cycle is repeated.

Inasmuch as the back pressure of turbine 10 is directly related to the cold water temperature entering condenser 14, the back pressure on turbine 10 will be controlled in two ways. First, the hotter water produced in heat exchanger 23 enables the cooling tower to operate more efficiently by augmenting its thermal fan action. Secondly, steam extracted from the turbine steam cycle lessens the heat load on the main condenser while generating a refrigeration cycle to lower the temperature of the condenser coolant in chiller 25.

Figure 2:
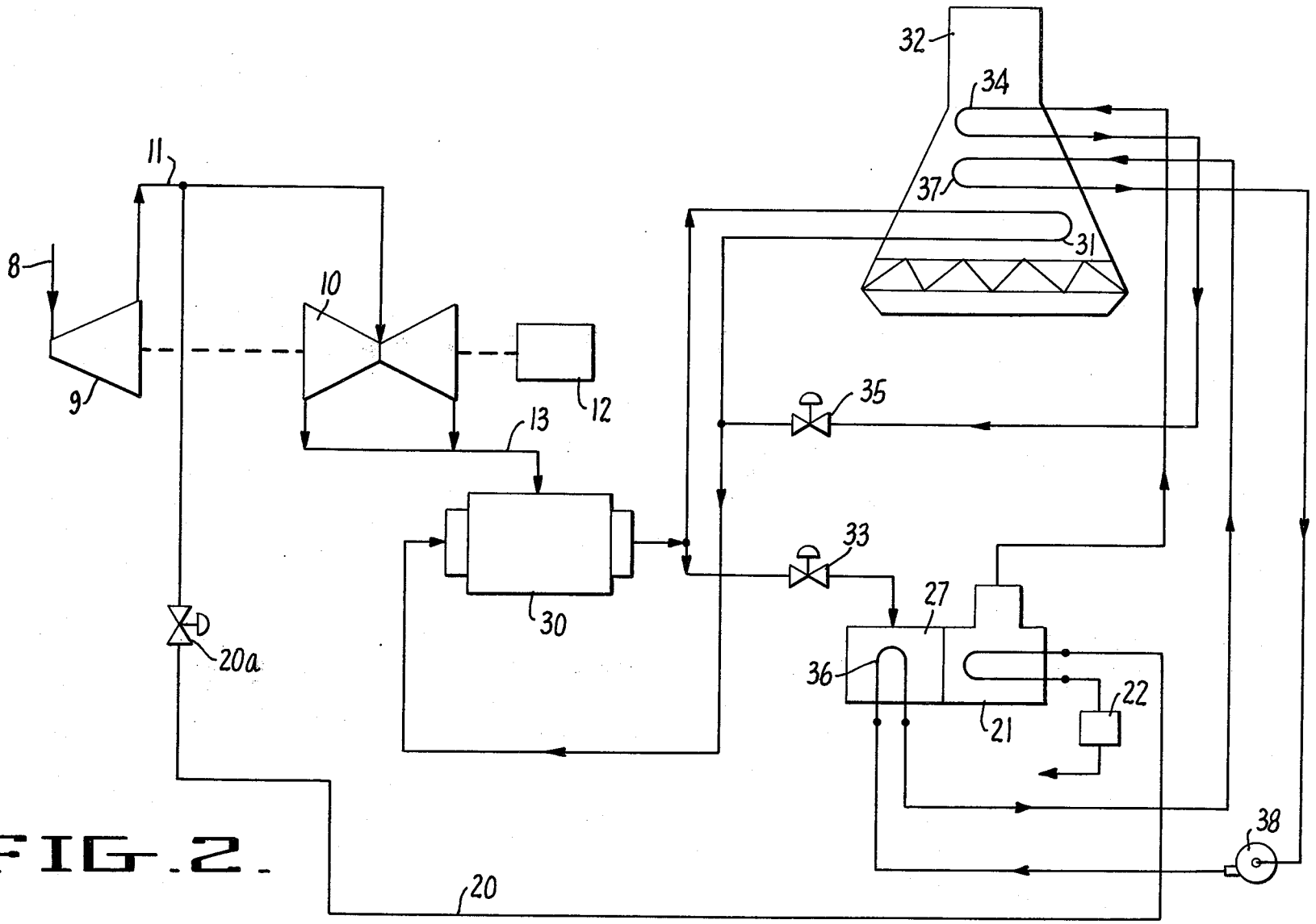
FIG. 2 is a diagram of apparatus for practicing the invention with a dry cooling tower system and applying removed steam to a vapor absorption system.

FIG. 2 illustrates a method for limiting the back pressure in a dry cooling tower. In this system, the exhaust from turbine 10 is cooled in a condenser 30 having a vapor coolant such as ammonia that connects in a closed system with a main condenser coil 31 of a dry cooling tower 34. In accordance with conventional practice, reboiled vapor is liquified in the dry cooling tower and recycled through the condenser 30 for cooling the turbine exhaust steam.

As with the method and apparatus described in FIG. 1, steam is removed from the turbine cycle when the back pressure of turbine 10 exceeds a preset limit, and the steam is supplied to the heat exchanger of generator 21 through a steam line 20 and a control valve 20*a*. Unlike FIG. 1, however, the vapor absorption system of FIG. 2 is supplied with a portion of the vapor from the outlet of condenser 30, thus reducing the amount of vapor, or heat to the main coil 31, thereby more effectively lowering the temperature of the coolant returning to the condenser. Heat of absorption from the vapor is applied directly to cooling tower 32 by connecting the absorber 27 directly to the exhaust vapor line of condenser 30 through a valve 33; circulating the high temperature vapor produced in generator 21 through an auxiliary cooling coil 34 provided in tower 32; passing the cooled vapor through an expansion valve 35, returning liquified vapor to the supply line for condenser 30; removing heat from the vapor entering absorber 27; and conveying that heat to the cooling tower by means of a circulating water system comprising a coil 36 in absorber 27, a coil 37 in cooling tower 32 and a circulating pump 38.

Figure 3:
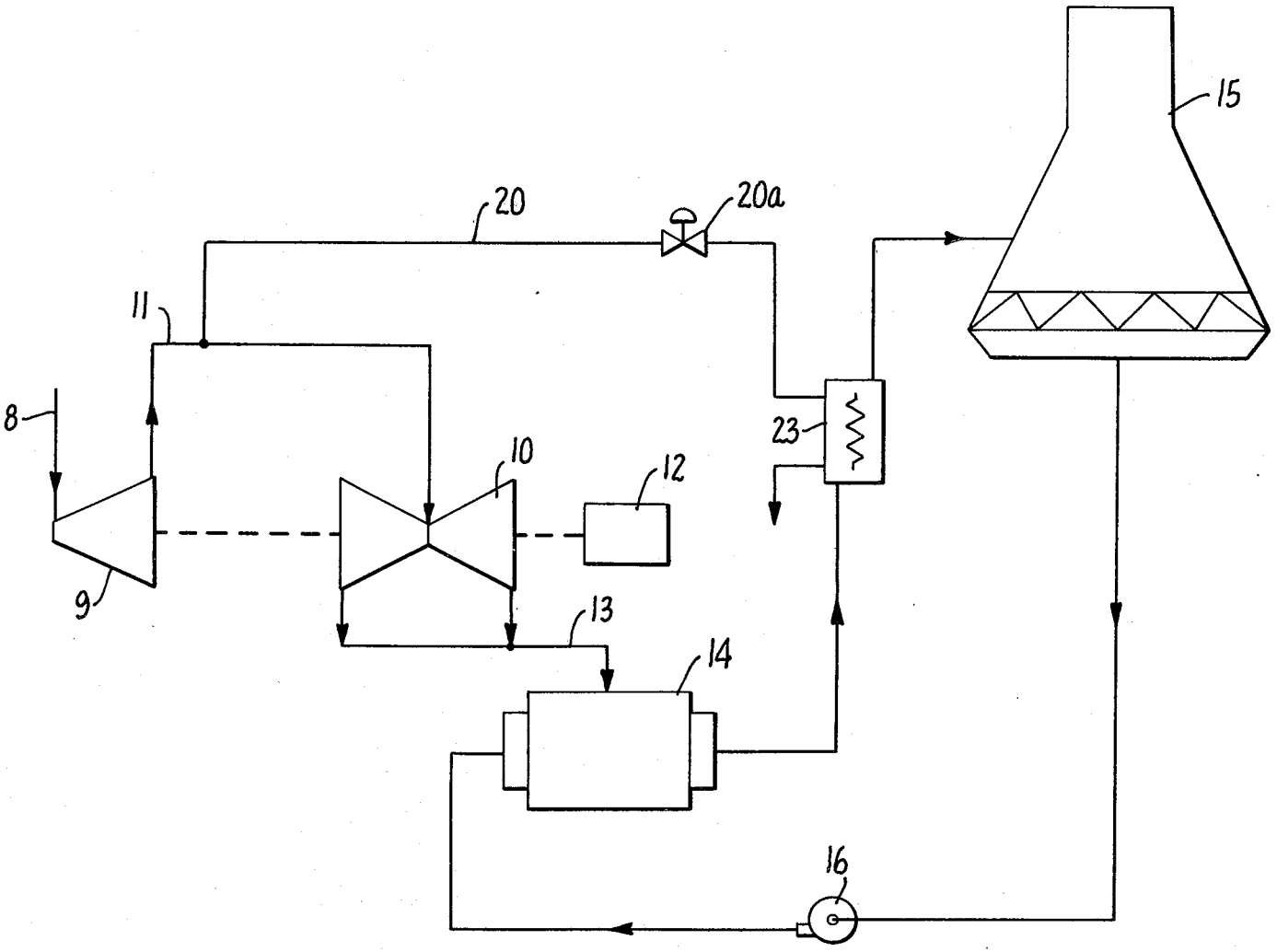
FIG. 3 is a diagram of apparatus for practicing the invention in connection with a wet cooling tower system and applying removed steam to a heat exchanger.

FIG. 3 illustrates an alternative system utilizing removed steam from the turbine cycle to increase the temperature in the cooling tower of a wet cooling tower system. In this system, as with the system shown in FIG. 1, exhaust steam from a turbine 10 is cooled in a water cooled condenser 14. The cooling water from condenser 14 is passed first through a heat exchanger 23 and then through cooling tower 15; and the coolant is circulated by a pump 16.

In the event that the back pressure on turbine 10 exceeds a predetermined level, steam is removed from the turbine cycle by opening a control valve 20*a* in a steam line 20, allowing steam to pass through heat exchanger 23 to further heat the cooling water from condenser 14. This results in an increased temperature at the cooling tower augmenting thermal fan action increasing the rate of cooling, and reducing the coolant temperature returned to the condenser.

Figure 4:
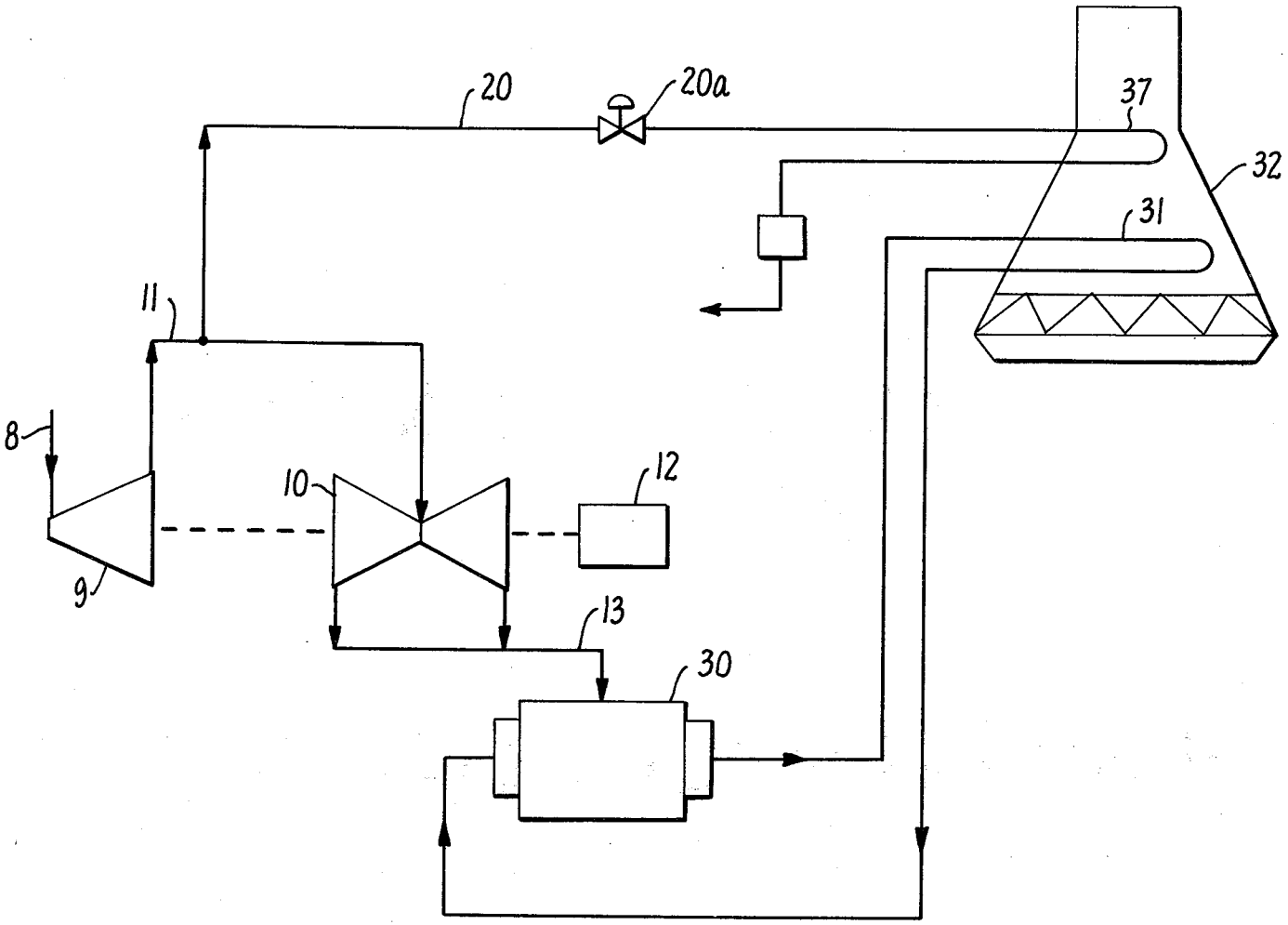
FIG. 4 is a diagram of apparatus for practicing the invention in connection with a dry cooling tower system and applying removed steam to an auxiliary cooling coil.

FIG. 4 illustrates another method of the invention for operating a dry cooling tower system wherein steam removed from the turbine cycle is applied to an auxiliary coil in the tower. The exhaust steam from turbine 10 is cooled in a condenser 30 through which a coolant is circulated in a closed system including a coil 31 of cooling tower 32. The vapor in coil 31 is cooled by air circulation in the cooling tower and returns as liquid to condenser 30. When the back pressure on the turbine exceeds a predetermined level, steam is removed from the turbine cycle through a conduit 20 including a control valve 20*a*, and the steam circulates through an auxiliary heat exchanger or coil 37 of tower 32.

In operation, the condensing steam in coil 37 further heats the air in the cooling tower, thereby improving the natural draft of the cooling tower. This further cools the condensing liquid in heat exchanger coil 31 and limits the back pressure on the turbine 10.

It will be apparent that various forms of apparatus may be used in the practice of this invention, several forms thereof having been described. Moreover, many modifications and changes may be made without departing from the spirit of the invention or the scope of the attached claims, and each of such modifications and changes is contemplated.

What is claimed is:

1. An improved method for operating a steam turbine wherein a steam turbine exhaust connects to a steam condenser having a coolant circulated through a cooling tower, comprising the steps: removing steam from the steam cycle of a turbine when the back pressure on the turbine exceeds a predetermined level; extracting heat from the steam and applying the heat to the cooling tower, thereby increasing temperatures in the cooling tower, augmenting thermal fan action, lowering the coolant temperature and limiting the back pressure on the steam turbine; and redirecting the steam back into the steam cycle when the back pressure on the turbine decreases to an acceptable level.

2. The method of claim 1, wherein the extracted heat is applied to the cooling tower by increasing the temperature of coolant discharged from the steam condenser.

3. The method of claim 1, wherein the extracted heat is applied to the cooling tower by heating a vapor to high temperature, and circulating coolant discharged from the steam condenser in heat-exchange relationship with the high temperature vapor.

4. The method of claim 1, wherein the extracted heat is applied to the cooling tower by heating a vapor to high temperature, and circulating the high temperature vapor through an auxiliary coil in the cooling tower.

5. The method of claim 1, wherein the removed steam is passed through the coil of a generator in a vapor absorption cooling system that produces a high temperature vapor, and circulating the high temperature vapor in direct heat-exchange relationship with the cooling tower.

6. The method of claim 1, wherein the removed steam is passed through the high temperature coil of a generator in a vapor absorption cooling system that produces a high temperature vapor, then circulating the high temperature vapor in heat-exchange relationship with the coolant discharged from the steam condenser.

7. The method of claim 1, wherein the removed steam is passed through the high temperature coil of a generator in a vapor absorption cooling system that produces a low temperature vapor, then circulating the low temperature vapor in heat-exchange relationship with the coolant of the steam condenser as it returns from the cooling tower.

8. An improved method for operating a steam turbine cycle wherein a steam turbine exhaust connects to a steam condenser and a coolant circulates through the steam condenser and heat dissipating surfaces, comprising the steps: removing steam from the steam cycle when the back pressure on the turbine exceeds a predetermined level; passing the steam through the high temperature coil of a generator in a vapor absorption cooling system while producing a high temperature vapor; circulating the high temperature vapor of the cooling system through heat dissipating surfaces, thereby cooling the vapor to a liquid; expanding the liquid and circulating the resulting cold vapor in heat-exchange relationship to the coolant before it enters the steam condenser; and redirecting the steam back into the steam cycle when the back pressure on the turbine decreases to an acceptable level.

9. A method for limiting back pressure on a steam turbine to maintain operability, comprising the steps:

removing steam from the steam cycle of a turbine; passing the steam through the high temperature coil of a generator in a vapor absorption cooling system while producing a high temperature vapor; circulating the high temperature vapor of the cooling system through heat dissipating surfaces of a cooling tower, whereby the increased temperatures of the cooling tower augment thermal fan action.

10. A method for limiting back pressure on a steam turbine to maintain operability, comprising the steps: removing steam from the steam cycle of a turbine; passing the steam through the high temperature coil of a generator in a vapor absorption cooling system while producing a high temperature vapor; circulating the high temperature vapor of the cooling system through the high temperature coil of a heat exchanger; circulating the exhaust coolant from a steam condenser through the low temperature coil of the heat exchanger and heat dissipating surfaces of a cooling tower, whereby the increased temperatures of the coolant in the cooling tower augment thermal fan action.

11. The method of claim 10, wherein the cooled vapor leaving the cooling tower is liquified, expanded and circulated to lower the temperatures of the coolant after it leaves the cooling tower and before it enters the steam condenser.

* * * * *

UNITED STATES PATENT OFFICE

CERTIFICATE OF CORRECTION

Patent No. 4,004,424 Dated January 25, 1977

Inventor(s) Aswath Maddagiri

It is certified that error appears in the above-identified patent and that said Letters Patent are hereby corrected as shown below:

Column 1, line 58, "temperature" has been omitted between "atmospheric" and "conditions".

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*